US009718603B2

(12) United States Patent
Lopez Masague

(10) Patent No.: US 9,718,603 B2
(45) Date of Patent: Aug. 1, 2017

(54) WARDROBE BOX

(71) Applicant: Embalajes Capsa, S.L., Canet de Mar (ES)

(72) Inventor: Manuel Lopez Masague, Canet de Mar (ES)

(73) Assignee: EMBALAJES CAPSA, S.L., Canet de Mar (ES)

( * ) Notice: Subject to any disclaimer, the term of this patent is extended or adjusted under 35 U.S.C. 154(b) by 0 days.

(21) Appl. No.: 15/155,835

(22) Filed: May 16, 2016

(65) Prior Publication Data

US 2016/0257483 A1 Sep. 8, 2016

Related U.S. Application Data

(63) Continuation of application No. 14/563,433, filed on Dec. 8, 2014, now Pat. No. 9,340,348, which is a (Continued)

(30) Foreign Application Priority Data

May 14, 2007 (ES) ..... 200701358

(51) Int. Cl.
*B65D 85/18* (2006.01)
*B65D 5/10* (2006.01)
(Continued)

(52) U.S. Cl.
CPC ..... *B65D 85/185* (2013.01); *A47B 61/06* (2013.01); *B65D 5/10* (2013.01); *B65D 5/16* (2013.01);
(Continued)

(58) Field of Classification Search
CPC .... B65D 75/14; B65D 5/2057; B65D 5/2052; B65D 5/4254; B65D 5/0227; B65D 5/106;
(Continued)

(56) References Cited

U.S. PATENT DOCUMENTS 285,706 A 9/1883 Tatum
2,974,779 A 4/1957 Belsinger
(Continued)

FOREIGN PATENT DOCUMENTS

| | | |
|---|---|---|
| CA | 2323577 | 7/2001 |
| ES | 2320073 | 5/2009 |
| FR | 2712869 | 6/1996 |
| GB | 700741 | 12/1953 |
| WO | PCT/US00/24318 | 3/2001 |

OTHER PUBLICATIONS

Notice of References Cited (form PTO-892) issued by the Examiner in the U.S. Appl. No. 13/667,342 of the parent application on Aug. 18, 2014.

*Primary Examiner* — Robert J Hicks
(74) *Attorney, Agent, or Firm* — Edell, Shapiro & Finnan LLC

(57) ABSTRACT

The wardrobe box comprises a lid a bottom and side walls, comprising also a door at one of its side walls, wherein the lid comprises two hinged sectors engageable to each other. The sectors of the lid comprise preferably complementary flaps engageable to each other, and the door comprises a detachable closing element. This permits to use no additional closing element, such as e.g. adhesive tape, to close the lid and to keep the door closed.

14 Claims, 3 Drawing Sheets

Related U.S. Application Data continuation of application No. 13/667,342, filed on Nov. 2, 2012, now Pat. No. 8,915,420, which is a continuation of application No. 12/600,081, filed as application No. PCT/IB2008/051903 on May 14, 2008, now abandoned.

(51) Int. Cl.

| | |
|---|---|
| ***B65D 5/16*** | (2006.01) |
| ***B65D 5/66*** | (2006.01) |
| ***A47B 61/06*** | (2006.01) |

(52) U.S. Cl.

CPC ..... *B65D 5/6602* (2013.01); *B65D 5/6605* (2013.01); *B65D 2313/02* (2013.01)

(58) Field of Classification Search

CPC . B65D 5/103; B65D 5/10; B65D 5/16; B65D 5/6605; B65D 5/6602; B65D 5/66; B65D 85/185; B65D 85/18; B31B 1/62; A47B 61/06

USPC ... 220/254.6, 254.3, 810, 254.2, 254.1, 212; 229/103.3, 103, 117.13, 117.12, 122, 138, 229/127, 126, 124, 155, 158; 206/299, 206/298

See application file for complete search history.

(56) References Cited

U.S. PATENT DOCUMENTS

| | | | | | |
|---|---|---|---|---|---|
| 3,112,027 | A | | 11/1963 | Field et al. | |
| 3,272,421 | A | | 9/1966 | Perry | |
| 3,294,221 | A | * | 12/1966 | Notko | B65D 85/185 206/289 |
| 3,891,137 | A | * | 6/1975 | Ellison | B65D 5/16 220/560.15 |
| 4,013,213 | A | | 3/1977 | Giebel et al. | |
| 4,293,069 | A | * | 10/1981 | Partain | B65D 85/185 206/279 |
| 4,953,782 | A | | 9/1990 | Noland | |
| 8,915,420 | B2 | | 12/2014 | Masague | |
| 2005/0011938 | A1 | | 1/2005 | West | |
| 2010/0308067 | A1 | | 12/2010 | Masague | |

* cited by examiner

WARDROBE BOX

CROSS REFERENCE TO RELATED APPLICATIONS

This application is a continuation of U.S. application Ser. No. 14/563,433, filed Dec. 8, 2014, which is a continuation of U.S. application Ser. No. 13/667,342, filed Nov. 2, 2012, currently U.S. Pat. No. 8,915,420; which is a continuation of U.S. application Ser. No. 12/600,081, filed Dec. 11, 2009, now abandoned, which claims the priority of PCT Application No. PCT/IB2008/051903, filed May 14, 2008; which in turn claims priority of Spanish Patent Application P-200701358 Filed May 14, 2007 the entire contents of which are herein incorporated by reference.

FIELD OF THE INVENTION

The present invention refers to a wardrobe box, specially designed to contain and transport clothes hung from hangers.

BACKGROUND

Wardrobe boxes are used to contain and transport clothes hung from hangers. To this end, wardrobe boxes comprise a transversal bar, from which the hangers hang. This transversal bar is usually engaged on the upper edge of the wardrobe box.

To place or remove the clothes into or out of the wardrobe box, the wardrobe box comprises an upper lid. Usually, to transport the wardrobe box, the upper lid must be closed by a closing element, e.g., adhesive tape.

To place and remove the clothes, each wardrobe boxes comprises a door at one of its side walls.

Furthermore, to facilitate the transportation of the wardrobe box, it comprises handle-like holes in two opposed side walls of the wardrobe box.

The known wardrobe boxes have several drawbacks. Firstly, to close the door of the wardrobe box it is necessary to place the closing element on the lid, because if it is not closed, the lid can be opened. The placement of the closing element each time the lid is closed is uncomfortable, and when the closing element is removed the lid can be damaged, so that the wardrobe box cannot be used several times.

SUMMARY

With the wardrobe box of the invention said drawbacks can be solved, presenting other advantages that will be described.

The wardrobe box of the present invention comprises a lid, a bottom and side walls, and it is characterised in that said lid comprises two hinged sectors engageable to each other.

Therefore, it is not necessary to use an additional closing element, such as e.g. adhesive tape, to close the lid and to keep the door closed, unlike the known wardrobe boxes. Furthermore, it permits to use less material than the conventional wardrobe boxes.

Advantageously, said sectors of the lid comprise complementary flaps engageable to each other.

Preferably, the door of the wardrobe box of the present invention comprises a detachable closure, that according to a preferred embodiment, is made from Velcro®, i.e. is formed by the bands engageable to each other, one provided with a plurality of hooks and the other one provided with a velvet material, one of the bands being placed on said door and the other one on the adjacent side wall against which the door closes.

With respect to the bottom of the wardrobe box of the present invention, it comprises formed flaps engageable to each other.

BRIEF DESCRIPTION OF THE DRAWINGS

For a better understanding of what has been described some drawings are attached in which, diagrammatically and only as a non-limitative example, a practical case of embodiment is shown.

DETAILED DESCRIPTION

As it can be seen in the figures, the wardrobe box of the present invention comprises a lid 1, a bottom 2 and four side walls 3, one of said side walls 3 being provided with a door 4.

Figure 1:
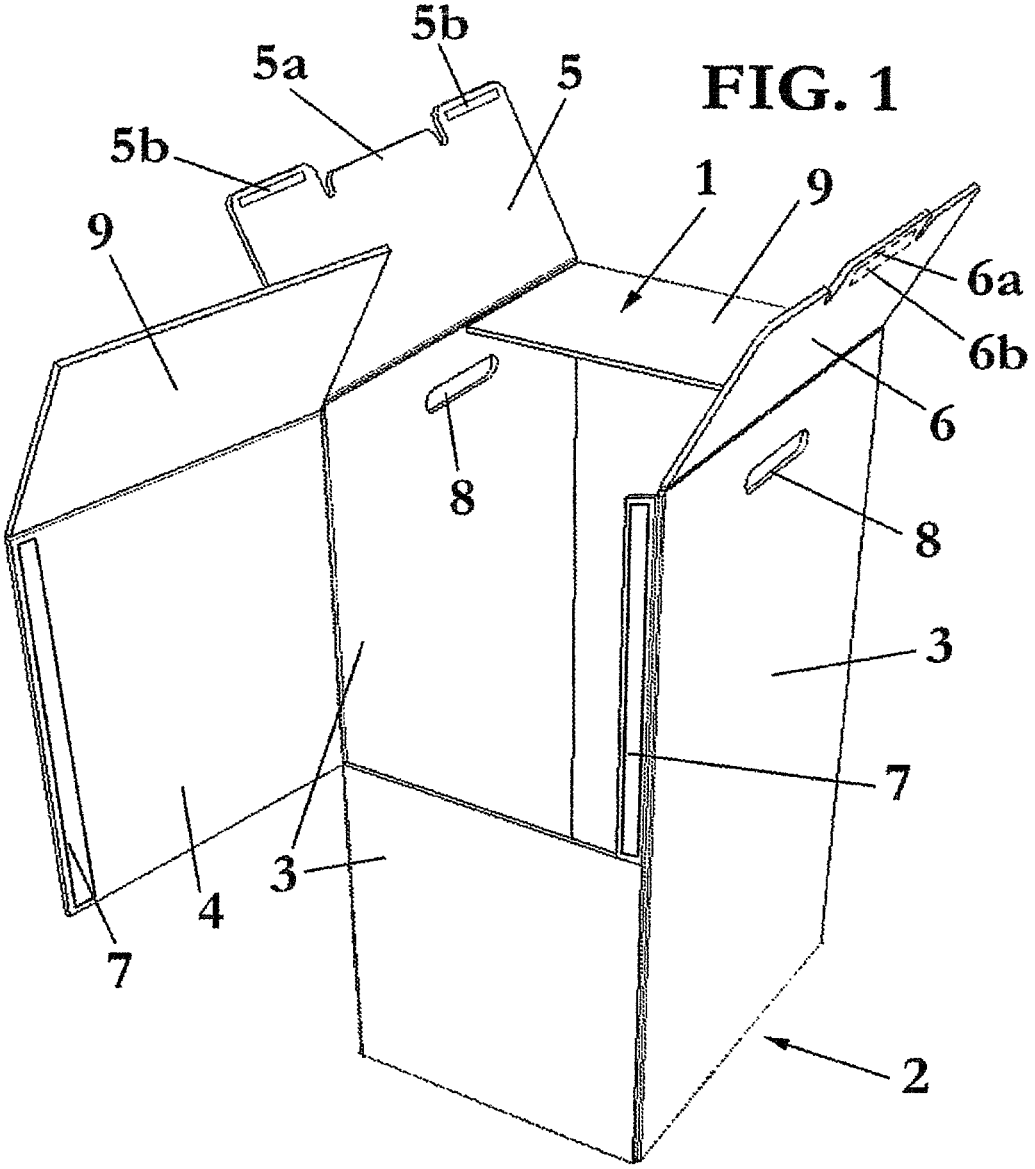
FIG. 1 is a perspective view of the wardrobe box of the present invention with its lid and its door opened.
Figure 2:
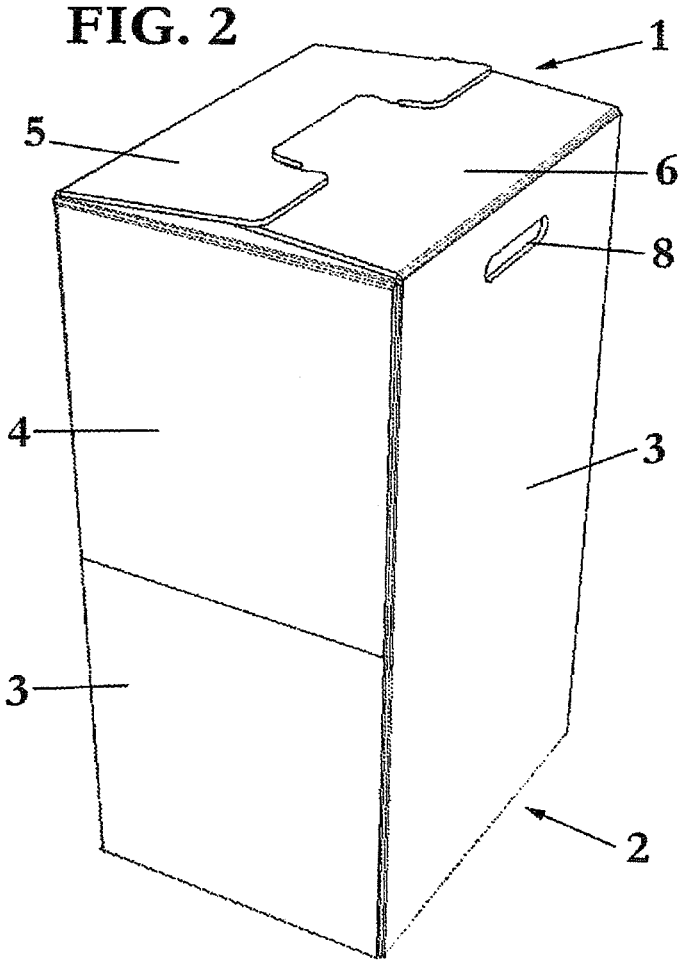
FIG. 2 is a perspective view of the wardrobe box of the present invention closed.
Figure 3:
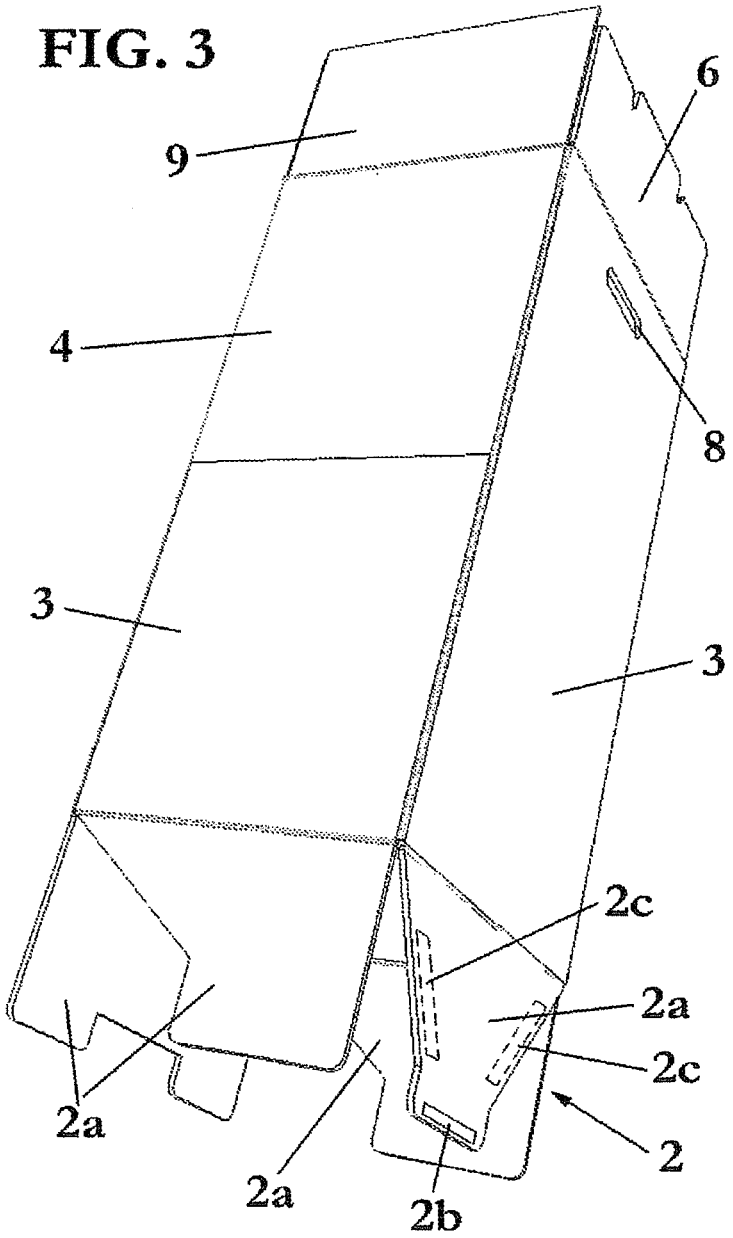
FIG. 3 is a perspective view of the wardrobe box of the present invention with its lid and its bottom opened.

The lid 1 comprises two hinged sectors 5 and 6 engageble to each other by flaps 5*a* and 6*a* provided in these sectors. It is illustrated in FIGS. 1-3 that in the sector 5, the first flap 5*a* is disposed between two side regions 5, so as to extend inwardly to form a recess. In the sector 6, a second flap 6*a* is positioned between two side regions, extending outwardly therefrom to form a projection. It is also shown in FIG. 1, that the first flap 5*a* is formed with a pair of spaced grooves extending inwardly from a level of the recess. The second flap 6*a* is formed with a pair of spaced grooves extending inwardly from a level of the side regions, These hinged sectors 5, 6 permit to close the lid 1 with no external closing element, such as e.g. adhesive tape.

The lid 1 can also comprise a pair of additional flaps 9 to reinforce it, that are folded below said hinged sectors 5, 6.

Furthermore, the lid 1 comprises adhesives 5*b*, 6*b* to keep said hinged sectors 5, 6 joined to each other. Preferably, said adhesives 5*b*, 6*b* are double-sided adhesives tapes.

When the lid 1 is closed, the door 4 is also closed, which means that the door 4 can be closed also with no external closing element.

The door 4 also comprises a detachable closing element 7, made up from two complementary bands of Velcro® or adhesive, one placed in the door 4 and the other one placed on the adjacent side wall 3. This detachable Velcro® closing element or adhesive permits to open and close the door 4 any tunes not damaging the wardrobe box of the present invention.

Two opposed side walls 3 comprise holes 8 provided to house the ends of a transversal bar (not shown) to hang the hangers for cloths that will be placed inside the wardrobe box of the present invention.

This transversal bar is the same that is disclosed in the Spanish Utility Model U9500827, which is included here as reference, whose inventor is the same than the inventor of this Application.

The use of this transversal bar permits to provide handles at their ends, and it permits at the same time to close completely the wardrobe box, preventing the entrance of dust.

The bottom 2 of the wardrobe box of the present invention is made up from flaps 2*a* engageable to each other, as it can be seen from FIG. 3.

Said bottom 2 also comprises adhesives 2*b*, 2*c* that join the flaps 2*a* to each other. Preferably, said adhesives 2*b*, 2*c* are double-sided tapes.

Even though reference is made to a specific embodiment of the invention, it is apparent for a person skilled in the art that the described wardrobe box is susceptible of numerous variations and modifications, and that all the details cited can be substituted by other technically equivalent ones, without departing from the scope of protection defined by the attached Claims.

What is claimed is:

1. A wardrobe box, comprising:

a bottom, a top, and side walls;

at least one opening defined in at least one of the side walls, and at least one door horizontally or vertically pivotably coupled to at least one of the side walls, the at least one door being configured to cover the at least one opening; and a lid configured to cover the top, comprising:

a first sector pivotably coupled to a first side wall of the side walls; and a second sector pivotably coupled to a second side wall of the side walls, wherein the second sector is capable of engaging the first sector;

wherein the first sector and second sector are usable to close the lid to cover the top and each time the lid is closed, the at least one door is moved to a closed position without an external closing element.

2. The wardrobe box according to claim 1, wherein the first sector is formed with a central region disposed between two side regions and further comprises:

a first flap formed in the central region of the first sector, which extends inwardly from a level of said side regions to form a recess.

3. The wardrobe box according to claim 2, wherein the second sector is formed with a central region disposed between two side regions and further comprises:

a second flap formed in the central region of the second sector, which extends outwardly from a level of the side regions to form a projection and when the wardrobe box is in the closed condition said projection of the second flap is received within said recess of the first flap.

4. The wardrobe box according to claim 3, wherein:

the first flap further comprises a first pair of engaging grooves that are spaced from each other and extend inwardly from the recess;

the second flap further comprises a second pair of engaging grooves that are spaced from each other and extend inwardly from the side regions of the second flap; and the first pair of engaging grooves are configured to engage the second pair of engaging grooves when the lid is closed.

5. The wardrobe box according to claim 3, wherein the side regions of the first flap are positioned over the side regions of the second flap when first flap engages the second flap.

6. The wardrobe box according to claim 3, wherein said side regions of the first flap are provided with an adhesive, said adhesive being adjacent to the respective engaging grooves, so as to reinforce closing of the lid and prevent accidental opening of the box.

7. The wardrobe box according to claim 6, wherein said adhesive is symmetrical with respect to the central region of the first flap.

8. The wardrobe box according to claim 3, wherein said projection of the second flap is provided with an adhesive, so as to reinforce the lid closing and prevent accidental opening of the box.

9. The wardrobe box according to claim 1, wherein said door comprises a detachable closing element.

10. The wardrobe box according to claim 9, wherein the detachable closing element of the door comprises two bands engageable to each other, wherein one of the two bands is provided with a velvet material, and wherein one of the two bands is placed on said door and the other band is placed adjacent a side wall of the side walls against which said door is closed.

11. The wardrobe box according to claim 1, wherein said bottom comprises four flaps engaging each other.

12. The wardrobe box according to claim 1, wherein the first sector and the second sector are movable between (i) a first position in which the first sector and the second sector are engaged and the second sector is positioned over the first sector, and (ii) a second position in which the first sector and the second sector are spaced apart from each other.

13. The wardrobe box according to claim 1, wherein the lid further comprises:

a first additional flap; and a second additional flap, wherein the first additional flap and the second additional flap are disposed below the first sector and the second sector when the wardrobe box is in the closed condition and the first and second sectors are engaging each other.

14. The wardrobe box according to claim 13, wherein the door is pivotally connected to the first additional flap.

* * * * *